United States Patent [19]

Currie

[11] Patent Number: 4,765,000

[45] Date of Patent: Aug. 23, 1988

[54] BATHTUB ENCLOSURE

[76] Inventor: Gordon J. Currie, 46297 Prairie Central Road, Chilliwack, B.C., Canada, V2P 6H3

[21] Appl. No.: 919,037

[22] Filed: Oct. 15, 1986

[51] Int. Cl.[4] ..... A42K 3/02

[52] U.S. Cl. ..... 4/580; 4/524

[58] Field of Search ..... 4/580, 549, 551, 536, 4/524, 538, 535; 312/325; 128/1 B, 367, 368, 369, 370, 371; 160/213, 183, 352; 108/38, 48

[56] References Cited

U.S. PATENT DOCUMENTS

| | | | |
|---|---|---|---|
| 294,150 | 2/1884 | Ransom | 4/549 |
| 446,647 | 2/1891 | Rankin | 312/312 |
| 1,345,147 | 6/1920 | Donovan | 160/183 |
| 1,595,628 | 8/1926 | Small | 108/48 |
| 1,639,141 | 8/1927 | Mangels et al. | 297/14 |
| 1,954,869 | 4/1934 | Fitch | 160/183 |
| 1,982,859 | 12/1934 | Derbyshire | 4/551 |
| 2,229,060 | 1/1941 | Druckenmiller | 4/549 |
| 4,400,835 | 8/1983 | Richter | 4/551 |

FOREIGN PATENT DOCUMENTS

| | | | |
|---|---|---|---|
| 2841019 | 4/1980 | Fed. Rep. of Germany | 4/580 |
| 2091996 | 8/1982 | United Kingdom | 4/580 |

*Primary Examiner*—Henry J. Recla
*Assistant Examiner*—Linda J. Sholl
*Attorney, Agent, or Firm*—Lee & Smith

[57] ABSTRACT

An enclosure for a bathtub for creating an environment of contained heat and high humidity. The enclosure is composed of two elongated panels, one horizontally oriented and the other vertically oriented, the panels being hinged together and the horizontal panel being hinged to the back wall adjacent the tub. A latch is located on the back wall so that the enclosure may be opened and the panels folded against one another and held against the back wall when the enclosure is not in use.

5 Claims, 2 Drawing Sheets

40
42
18
24
26
10
20

BATHTUB ENCLOSURE

BACKGROUND OF THE INVENTION

This invention relates to bathing facilities, and in particular to an enclosure for a bathtub to provide a chamber above the tub for creating a warm and humid environment.

Covers for containing the heat within a bathtub or similar structure are well know, as exemplified by West Germany Offenlegungsschrift No. 2841019. Such devices are intended to be removed or pivoted out of the way when the bathtub is used for bathing. Hoods or covers for bathtubs and similar devices have also been proposed, as examplified by U.S. Pat. No. 3,119,122. The purpose of the device of this patent is to create a heat or vapor chamber for the bather. Other examples of similar devices are U.S. Pat. Nos. 2,095,749 and 3,581,325.

A substantial disadvantage of previous chambers or enclosures for bathtubs has been their cumber some nature and complexity. Even when used in connection with a shower stall, as disclosed in U.S. Pat. No. 4,365,368, such devices tend to be complex, unwieldy, and commensurately expensive.

SUMMARY OF THE INVENTION

The present invention is an improvement over known structures for forming an enclosure about a bathtub. The invention is intended to be used in combination with a bathtub which is installed in a recess having a pair of opposite end walls abutting the ends of the tub and a back wall which adjoins the backside of the tub. The enclosure includes an elongated first panel which has a length substantially equal to the distance between the end walls, which has a width sufficient to span the bathtub, and which is normally disposed in a generally horizontal orientation. A second elongated panel, having a length equal to that of the first, is disposed in generally vertical orientation with one side resting on the bathtub.

A first hinge interconnects the two panels and a second hinge secures the horizontal panel to the back wall. A latch is located on the back wall and is spaced above the horizontal panel a distance substantially equal to the width of the horizontal panel such that the enclosure may be secured to the back wall with the panels folded against one another in a vertical orientation when the enclosure is not in use.

For ease of handling the enclosure, a handle is secured to the face of the vertical panel. A nonskid, rubber bumper is secured to the edge of the vertical panel which rests on the bathtub to maintain the enclosure in place over the bathtub.

BRIEF DESCRIPTION OF THE DRAWINGS

The invention is described in greater detail in the following description of an example embodying the best mode of the invention, taken in conjunction with the drawings, in which.

DESCRIPTION OF EXAMPLE EMBODYING THE BEST MODE OF THE INVENTION

Figure 1:
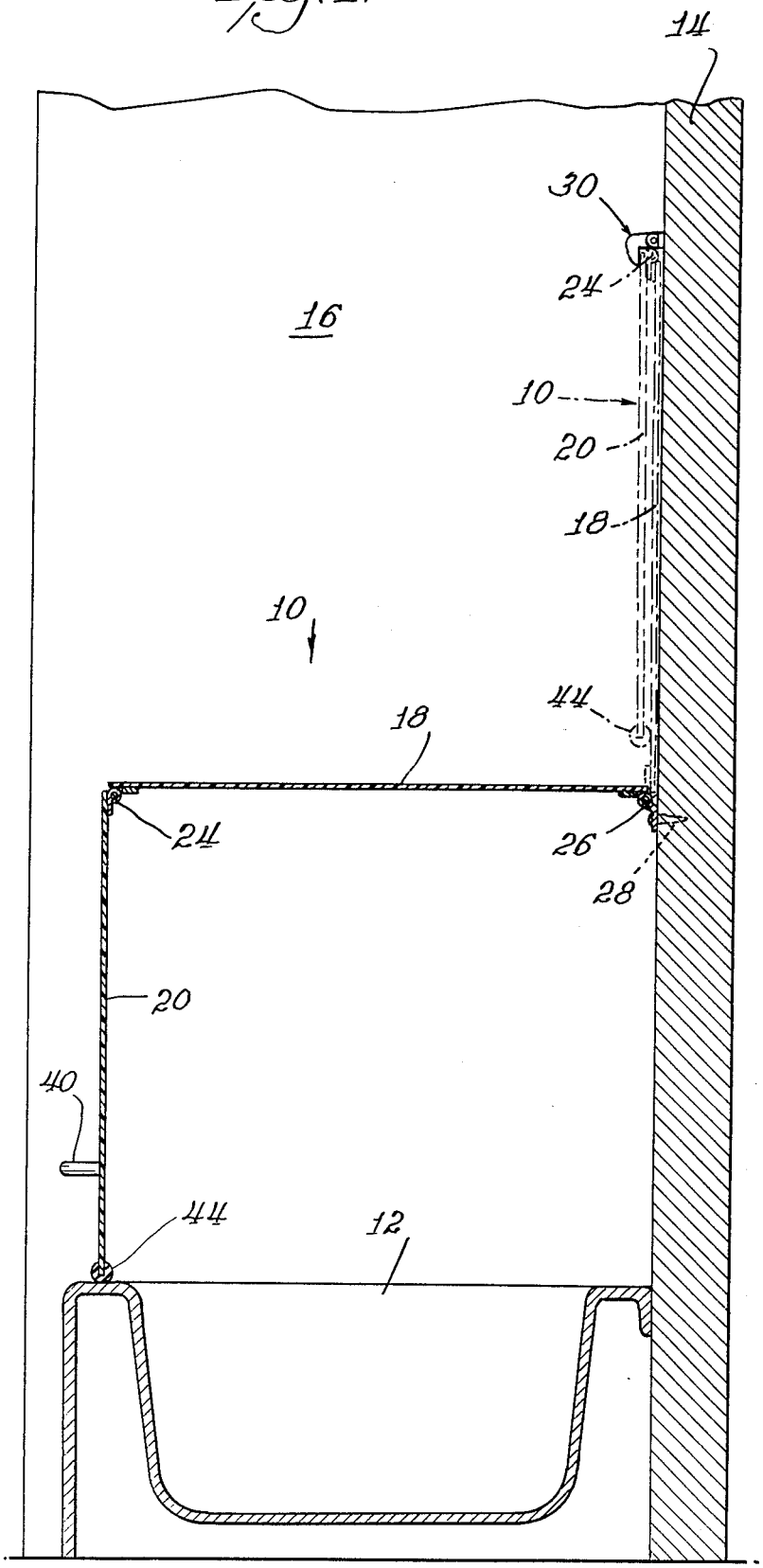
FIG. 1 is a cross-sectional elevational view of the invention when positioned for use.

An enclosure according to the invention is shown generally at 10 in the drawing figures. As shown in FIG. 1, the enclosure 10 is installed above a conventional bathtub 12 which in turn is typically installed against a back wall 14 and further is sandwiched between a pair of end walls 16, one of the end walls 16 being illustrated (and the second being identical to the first). The recess comprising the back wall 14 and end walls 16 is conventional for a modern bathing facility, and forms no part of the invention.

Figure 2:
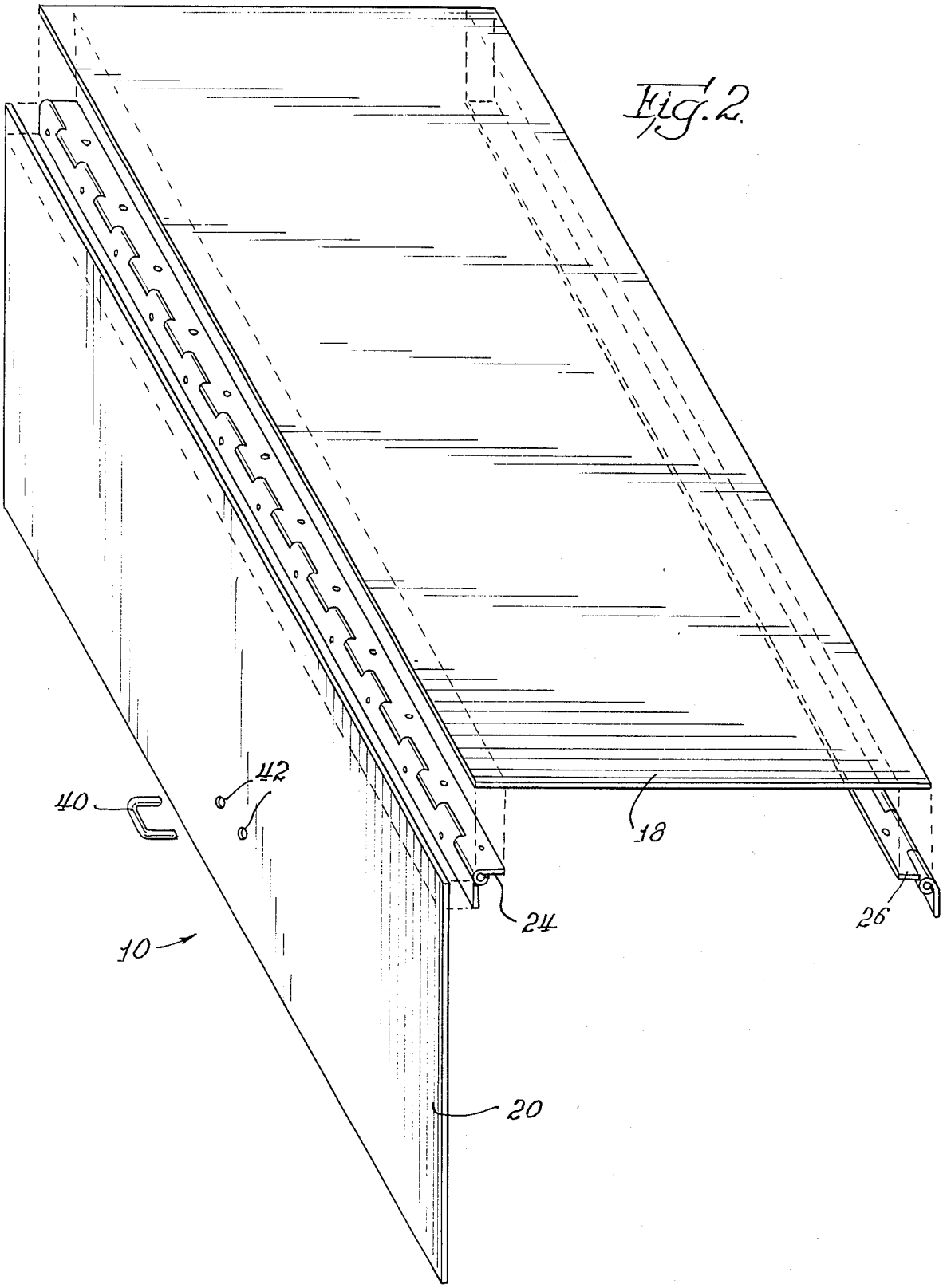
FIG. 2 is a perspective assembly view of the invention.

The enclosure 10 is composed of two primary elements, an elongated first panel 18 and an elongated second panel 20. As shown in FIGS. 1 and 2, the first panel 18 is normally disposed in a generally horizontal orientation. The length of the panel 18 is substantially equal to the distance between the end walls 16 for an appropriate seal therebetween, although air tightness is not necessary and may be detrimental if the bather were able to exhaust available oxygen contained within the enclosure 10. The width of the panel 18 is sufficient to span the majority of the width of the bathtub 12 as shown in FIG. 1.

The second panel 20 is normally disposed in a generally vertical orientation with one side edge resting on the bathtub 12. The length of the panel 20 is equal to that of the panel 18, and the width of the panel (in the vertical direction) is sufficient so that a chamber 22 is formed above the bathtub 12 of adequate head room and volume for the bather.

The panels 18 and 20 are joined at their abutting side edges by an elongated hinge 24 which is appropriately attached to each of the panels, as, for example, by rivets (not illustrated). The opposite side edge of the panel 18 is secured to a hinge 26 which in turn is secured to the back wall 14 by a series of screws 28 or other appropriate fasteners.

Figure 3:
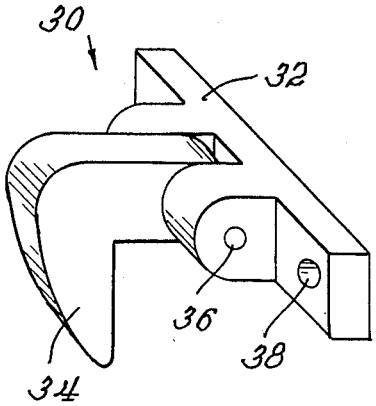
FIG. 3 is an enlarged perspective view of the latch utilized to secure the enclosure to the back wall when not in use.

When use of the bathtub 12 without the enclosure 10 is desired, the enclosure 10 is folded against the back wall 14 with the panels 18 and 20 folded against one another in a vertical orientation as shown in phantom in FIG. 1. To maintain the folded enclosure 10 in place, a latch 30 is installed on the back wall 14 above the horizontal position of the first panel 18 a distance substantially equal to the width of the horizontal panel 18. As best shown in FIG. 3, the latch 30 is composed of a body member 32 and a hook member 34 rotatively mounted by a pin 36 in the body member 32. Preferably, the body member 32 is provided with a series of apertures 38 for attachment to the wall by appropriate fasteners (not illustrated).

To facilitate both opening of the enclosure 10 and also folding of the enclosure 10 against the back wall 14, a handle 40 is provided which is secured appropriately to a pair of apertures 42 in the vertical panel 20. If necessary or desired, more than one handle 40 can be employed, or the handle 40 can be eliminated altogether.

It is important that the vertical panel 20 not inadvertently slip while resting on the bathtub 12. To provide a nonskid edge for the panel 20, a rubber bumper 44 is secured along the length of the panel 20. Alternatively, a stop or groove can be formed on or secured to the bathtub 12 where met by the side edge of the panel 20 to assure proper orientation of the enclosure 10.

The lengths of the panels 18 and 20 are sufficient to span the distance between the end walls 16. A slight clearance is normally provided to assure that the end walls will not interfere with folding of the enclosure 10 against the back wall 14. However, clearance is not so great as to permit cold drafts to enter the chamber 22 or permit the humid and warm environment within the chamber 22 to escape.

The panels 18 and 20 preferably are composed of a clear plastic material, such as plexiglass, and the hinges 24 and 26, handle 40 and latch 30 are formed of a non-corrodible material such as chrome plated steel which can withstand the humid atmosphere about the bathtub 12. For asthetic purposes, it is preferred that the latch 30 be formed of plexiglass or a like plastic material similar to that of the panels 18 and 20.

Various changes can be made to the invention without departing from the spirit thereof or scope of the following claims.

What is claimed is:

1. An enclosure for a bathtub, said bathtub being installed in a recess having a pair of opposite end walls and a back wall, the end walls being separated a predetermined distance substantially equal to the length of the bathtub, the enclosure comprising a. an elongated first panel having a length substantially equal to the distance between said end walls, having a width sufficient for spanning at least part of the bathtub, and having opposite side edges, said first panel being normally disposed in a generally horizontal orientation.

b. an elongated second panel having a length substantially equal to the length of the first panel, having a predetermined width, and having opposite side edges, said second panel being normally disposed in a generally vertical orientation with one side edge thereof for resting on the bathtub, c. first means for hingedly securing one side edge of the first panel to the back wall and second means for hingedly securing the other side edge of the first panel to the other side edge of the second panel for forming a chamber above the bathtub in combination with the end walls and the back wall of the recess, said first means permitting free rotation of said first panel relative to the back wall and said second means permitting free rotation of said panels relative to one another, d. latch means adopted to be mounted on said back wall above said horizontal first panel a distance substantially equal to the width of said first panel for securing said enclosure to said back wall with said panels folded against one another in a vertical orientation when the enclosure is not in use, and e. a nonskid strip secured to said one side edge of said second panel and extending substantially the length of sid second panel to prevent slippage of said second panel on the bathtub when said second panel rests on said bathtub in a generally vertical orientation and said first panel extends between the back wall and said second panel in a generally horizontal orientation.

2. An enclosure according to claim 1 including a handle secured to said second panel for aiding access to the interior of the enclosure.

3. An enclosure according to claim 1 in which said nonskid means comprises a rubber bumper extending the length of said second panel.

4. An enclosure according to claim 1 in which said first and second means comprise an elongated hinge.

5. An enclosure according to claim 1 in which said latch means comprises a body member secured to said back wall and a hook member rotatively mounted in said body member.

* * * * *